US010563491B2

(12) United States Patent
Oehler et al.

(10) Patent No.: US 10,563,491 B2
(45) Date of Patent: Feb. 18, 2020

(54) MITIGATING WATER INCLUSION IN DOWNHOLE PUMPS

(71) Applicant: Halliburton Energy Services, Inc., Houston, TX (US)

(72) Inventors: Matthew Wade Oehler, Katy, TX (US); Larry Steven Eoff, Porter, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 101 days.

(21) Appl. No.: 15/546,256

(22) PCT Filed: Feb. 25, 2015

(86) PCT No.: PCT/US2015/017447
§ 371 (c)(1),
(2) Date: Jul. 25, 2017

(87) PCT Pub. No.: WO2016/137454
PCT Pub. Date: Sep. 1, 2016

(65) Prior Publication Data

US 2018/0010432 A1 Jan. 11, 2018

(51) Int. Cl.

| | |
|---|---|
| ***E21B 43/12*** | (2006.01) |
| ***E21B 43/38*** | (2006.01) |
| ***E21B 43/08*** | (2006.01) |
| ***E21B 49/08*** | (2006.01) |
| *F04B 47/06* | (2006.01) |

(52) U.S. Cl.
CPC ..... *E21B 43/128* (2013.01); *E21B 43/08* (2013.01); *E21B 43/38* (2013.01); *E21B 49/08* (2013.01); *F04B 47/06* (2013.01)

(58) Field of Classification Search
CPC ..... E21B 43/128
USPC ..... 166/250.15
See application file for complete search history.

(56) References Cited

U.S. PATENT DOCUMENTS

| | | | | |
|---|---|---|---|---|
| 5,551,513 | A * | 9/1996 | Surles | B01D 39/2075 166/205 |
| 6,015,011 | A | 1/2000 | Hunter | |
| 6,228,812 | B1 | 5/2001 | Dawson et al. | |
| 6,476,169 | B1 | 11/2002 | Eoff et al. | |
| 7,823,635 | B2 | 11/2010 | Wright et al. | |
| 7,918,272 | B2 | 4/2011 | Gaudette et al. | |
| 8,476,366 | B2 | 7/2013 | Walton et al. | |

(Continued)

OTHER PUBLICATIONS

International Search Report and Written Opinion from PCT/US2015/-17447, dated Nov. 25, 2015.

*Primary Examiner* — Taras P Bemko
(74) *Attorney, Agent, or Firm* — McGuireWoods LLP

(57) ABSTRACT

Downhole pumps may include, at the inlet, a component that reduces the amount of water taken up by the pump. For example, a downhole assembly may include a tool string that includes a fluid pump, a fluid intake subassembly, a motor, and a downhole control system each coupled such that a fluid flowing into the fluid intake assembly is conveyed to the fluid pump; one or more inlets defined in the fluid intake subassembly; a flow line fluidly coupled to at least one of the one or more inlets and containing a filter component that contains a filter media at least partially coated with a relative permeability modifier (RPM), wherein the fluid flowing through the flow line contacts the RPM.

19 Claims, 3 Drawing Sheets

(56) References Cited

U.S. PATENT DOCUMENTS

| | | | | |
|---|---|---|---|---|
| 2007/0012444 | A1 | 1/2007 | Horgan et al. | |
| 2011/0034351 | A1* | 2/2011 | Eoff | C09K 8/508 507/212 |
| 2012/0318755 | A1* | 12/2012 | Paxton | A01K 63/045 210/791 |
| 2014/0352953 | A1 | 12/2014 | Gao et al. | |
| 2017/0204709 | A1* | 7/2017 | Weathers | E21B 43/084 |

* cited by examiner

MITIGATING WATER INCLUSION IN DOWNHOLE PUMPS

BACKGROUND

The present disclosure relates to downhole pumps.

In some instances, the reservoir pressure of a subterranean formation may be insufficient to carry fluids from the formation up a wellbore to a wellhead at the surface during production operations. To overcome low reservoir pressure, various artificial lift techniques that increase fluid flow to the surface can be used. For example, artificial lift may be accomplished by positioning a pump in the wellbore. Numerous types of pumps have been employed for artificial lift operations including plunger lifts, sucker rod pumps, progressive cavity pumps, and electric submersible pumps.

However, pumps are indiscriminant in the fluid composition flowing therethrough. Consequently, the water in the fluid from the formation will be produced with the hydrocarbons. Water, because of its greater density relative to the hydrocarbons, increases the wear on the pump mechanics and potential corrosion of pump surfaces, thereby reducing pump lifetime.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to downhole pumps that include, at the inlet, a component that reduces the amount of water taken up by the pump. Reducing the water taken up by the pump may reduce the mechanical wear and surface corrosion of the pump, thereby increasing the operable lifetime of the pump. Further, reduction of water in the fluids produced downhole reduces need to separate the water and hydrocarbons at the surface, which can be a costly and time-consuming process.

Figure 1:
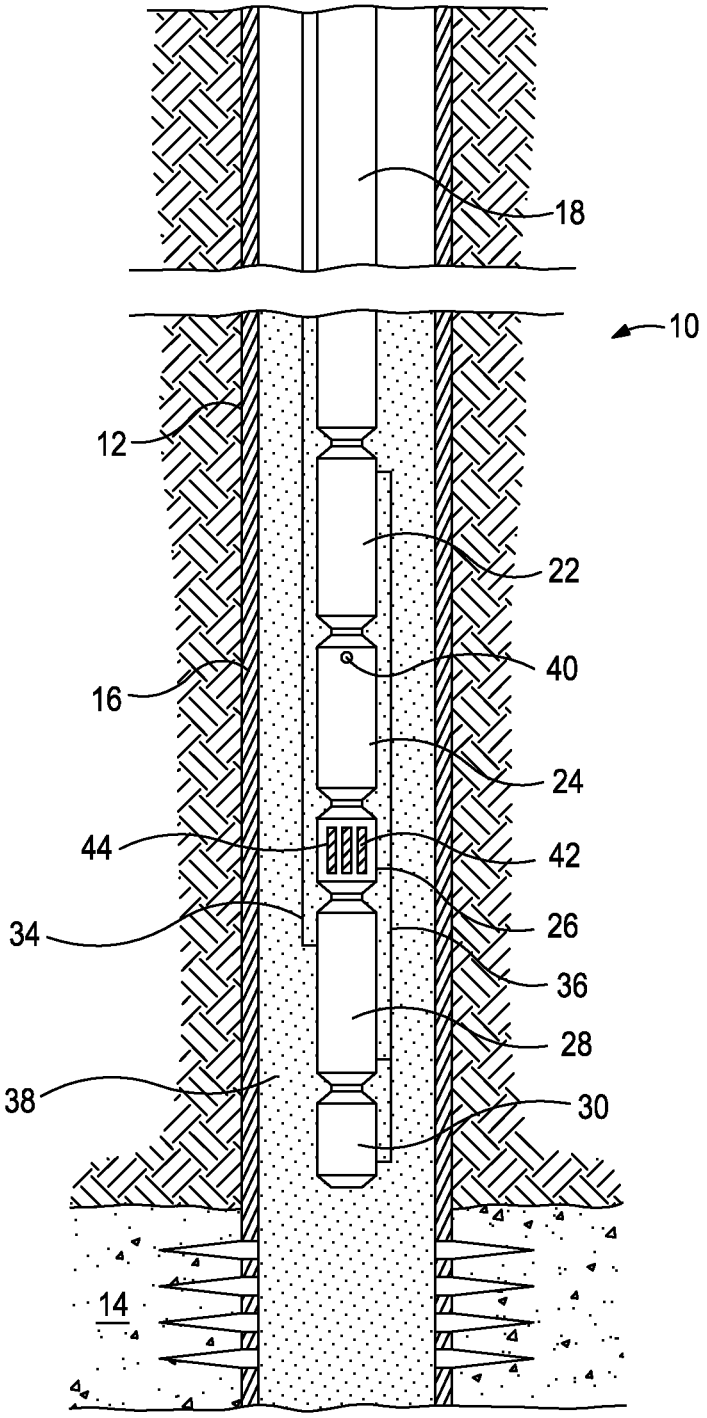
FIG. 1 is a schematic illustration of a submersible pump assembly positioned in a wellbore according to at least one embodiment described herein.

FIG. 1 is a schematic illustration of a submersible pump assembly 10 positioned in a wellbore 12 penetrating a subterranean formation 14 according to at least one embodiment described herein. A casing 16 is secured within wellbore 12, and a tubing string 18 is disposed within the wellbore 12. The lower end of tubing string 18 includes various tools such as a fluid pump 22 coupled to a gas separator 24, which may be coupled to a fluid intake subassembly 26, which may be coupled to a motor 28, which may be coupled to a downhole control system 30. Even though the submersible pump assembly 10 has been described and depicted as having a particular array and structural configuration of components, it should be understood by those skilled in the art that other arrangements and configurations of the components having a greater or lesser degree of functionality could alternatively be used, without departing from the principles of the present disclosure. For example, the gas separator 24 eliminated for no-gas or low-gas wells.

In the illustrated embodiment, a cable assembly 34 extends from the surface to provide power to various components of the submersible pump assembly 10. A second cable assembly 36 is depicted as extending among various components of the submersible pump assembly 10 to provide communication therebetween. Even though two cable assemblies 34, 36 have been described and depicted, it should be understood by those skilled in the art that the required power and signal capability could alternatively be handled by a single cable assembly. Further, the locations of the connections may be altered from the illustrative example without departing from the teachings of the present application.

In operation, if artificial lift is required to convey fluid 38 from the formation 14 to the surface of wellbore 12, the submersible pump assembly 10 may be lowered into wellbore 12 and placed in fluid communication with the fluid 38, as depicted in FIG. 1. Thereafter, electric power is supplied to the motor 28 via cable assembly 34. As the motor 28 rotates, the fluid enters the submersible pump assembly 10 at the fluid intake subassembly 26. The fluid 38 then passes through gas separator 24, which separates and discharges at least a portion of the gas fraction that may be present in the fluid 38 via one or more ports 40, for production to the surface, for example, in the annulus between casing 16 and tubing string 18. The remaining portion of the fluid 38 then enters the fluid pump 22, which sufficiently increases the pressure of the fluid 38 so it will flow to the surface within tubing string 18.

As discussed above, the lifetime of submersible pumps can be compromised when water is present in the fluid 38 from the subterranean formation 14. In the present disclosure, one or more filter components 42 may be coupled to one or more of the inlets 44 of the fluid intake subassembly 26. The filter components 42 may include a flow line containing a filter media at least partially coated with relative permeability modifiers (RPM), such that the fluid flowing through the flow path contacts and otherwise interacts with the RPM.

Without being limited by theory, it is believed that the RPMs may reduce the flow of water through the filter component 42 and, consequently, into the corresponding fluid pump 22. In some instances, RPMs are homopolymers or copolymers of hydrophilic monomers. In some instances, RPMs are copolymers of at least one hydrophobically modified hydrophilic monomer and at least one hydrophilic monomer. As used herein, the term "copolymer" is not limited to polymers comprising two types of monomeric units and, therefore, encompasses terpolymers, tetrapolymers, and the like. Further, the term "copolymer" encompasses any ordering of the two or more monomers include, but not limited to, random copolymers, alternating copolymers, block copolymer, graft copolymers, and the like.

The hydrophilic portion of the hydrophobically modified hydrophilic monomer and a hydrophilic monomer may be the same or may be different.

Examples of a hydrophilic monomer suitable for use as a hydrophilic monomer of the RPM or as the hydrophilic portion of a hydrophobically modified hydrophilic monomer of the RPM may include, but are not limited to, acrylamide, 2-acrylamido-2-methyl propane sulfonic acid, N,N-dimethylacrylamide, vinyl pyrrolidone, acrylic acid, dimethylaminopropylmethacrylamide ("DMAPMA"), trimethylammoniumethyl methacrylate chloride, methacrylamide, hydroxyethyl acrylate, dimethylaminoethyl methacrylate ("DMEMA"), and the like.

The hydrophobic portion of a hydrophobically modified hydrophilic monomer of the RPM may be a C4-C22 alkyl. As used herein, the term "alkyl" refers to hydrocarbon groups that may be linear or branched and saturated or unsaturated. Examples of hydrophobically modified hydrophilic monomers of the RPM may include, but are not limited to, C4-C22 alkyl acrylamides, C4-C22 alkyl methacrylates, C4-C22 alkyl acrylamides, C4-C22 alkyl methacrylamides, C4-C22 alkyl dimethylammoniumethyl methacrylate halides, C4-C22 alkyl dimethylammoniumpropylmethacrylamide halides, and the like.

By way of nonlimiting example, an RPM may be a copolymer of DMEMA and alkyl-DMEMA halide.

The relative amounts of the at least one hydrophobically modified hydrophilic monomer and at least one hydrophilic monomer in the RPM by weight of the RPM may range from about 10:90 to about 0.02:99.8.

The molecular weight of the RPM may range from about 250 kDaltons to about 3,000 kDaltons.

Figure 2:
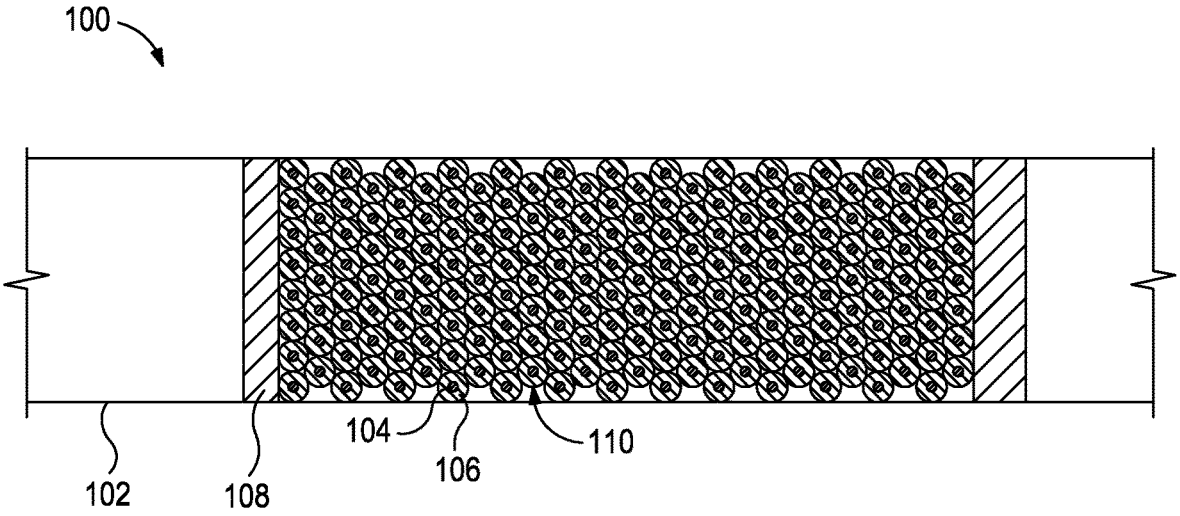
FIG. 2 is a schematic illustration of an exemplary filter component for use at the fluid intake portion of a submersible pump according to at least some embodiments described herein

FIG. 2 is a schematic illustration of an exemplary filter component 100 for use at the fluid intake portion of a submersible pump, according to at least some embodiments described herein. The filter component 100 may be similar to or the same as the filter component 42 of FIG. 1, and therefore may be used in conjunction with the fluid pump 22 and otherwise coupled to inlets 44 of the fluid intake subassembly 26 of FIG. 1. As illustrated, the filter component 100 may include a flow line 102 that contains a filter media 110, which is illustrated as particles 104 that are at least partially coated with an RPM 106. The position of the filter media 110 may be maintained within the flow line 102 with membranes 108, which are fluid permeable. One skilled in the art would recognize the various configurations, if needed, for containing the various embodiments of RPM-coated materials in the flow path.

As used herein, the term "flow line" refers to a route through which a fluid is capable of being transported between two points. Exemplary flow lines include, but are not limited to, a conduit, a hose, a tubing, a filter cartridge, and the like. It should be noted that the term "flow line" does not necessarily imply that a fluid is flowing therein, rather, that a fluid is capable of being transported or otherwise flowable therethrough.

Exemplary particles 104 suitable for use in conjunction with the filter components described herein may be formed of a material that includes, but is not limited to, sand, bauxite, ceramic materials, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and combinations thereof. Suitable composite particulates may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. The mean particulate size generally may range from about 2 mesh to about 400 mesh or less on the U.S. Sieve Series.

In some instances, the RPM may be a coating on a plurality of fibers rather than particles. In some instances, the RPM-coated fibers may be arranged as a nonwoven material (e.g., formed by RPM-coated melt blown fibers or RPM-coated staple fibers) that is secured in a flow line. In some instances, the RPM-coated fibers may be aggregated or woven in a rope-like configuration and contained in a tubular or other elongated flow line where fluid flows along the length of the RPM-coated fibers. In some instances, the fibers may be RPM-coated staple fibers and packed into a flow line to form the filter component.

Exemplary fibers suitable for use in conjunction with the filter components described herein may be formed of a material that includes, but is not limited to, ceramic materials, glass materials, polymer materials, carbon, and combinations thereof.

In some instances, RPM-coated fibers and RPM-coated particles may be used in combination.

In some instances, the filter media 110 may be a porous media with at least a portion of the surface coated with RPM. Examples of porous media may include, but are not limited to, open cell foamed polymers, porous minerals (e.g., pumicite), and the like.

The filter media 110 may be designed (e.g., particle size, fiber diameter, open cell size, and the like) such that the RPM-coated filter media 110 has a permeability for oil of greater than about 1 Darcy (e.g., about 1 Darcy to about 1000 Darcy, including any subset therebetween). Further, the permeability of water may be 0.5 times or less the permeability of oil (e.g., about 0.5 to about 0.001 times the permeability of oil). Permeability may be measured using a Hassler sleeve in which the RPM-coated filter media 110 is contained with 1500 psi confinement pressure. The oil (kerosene) or water (2% KCI solution) may then be injected into the system at a given pressure, and the permeability may be calculated according to known equations for calculating permeability.

The use of the filter component with an RPM-coated filter media therein may be preferably implemented in a subterranean formation with a sufficient flow capacity (e.g., from natural permeability or from water injection), such that the water that does not flow into the fluid pump subassembly because of exclusion by the filter component could readily flow into and out of the formation. Water flow in and out of the formation may allow for the fluid at the filter component to maintain a sufficiently high hydrocarbon concentration that the filter component has sufficient fluid flow from the hydrocarbon component of the fluid.

Figure 3:
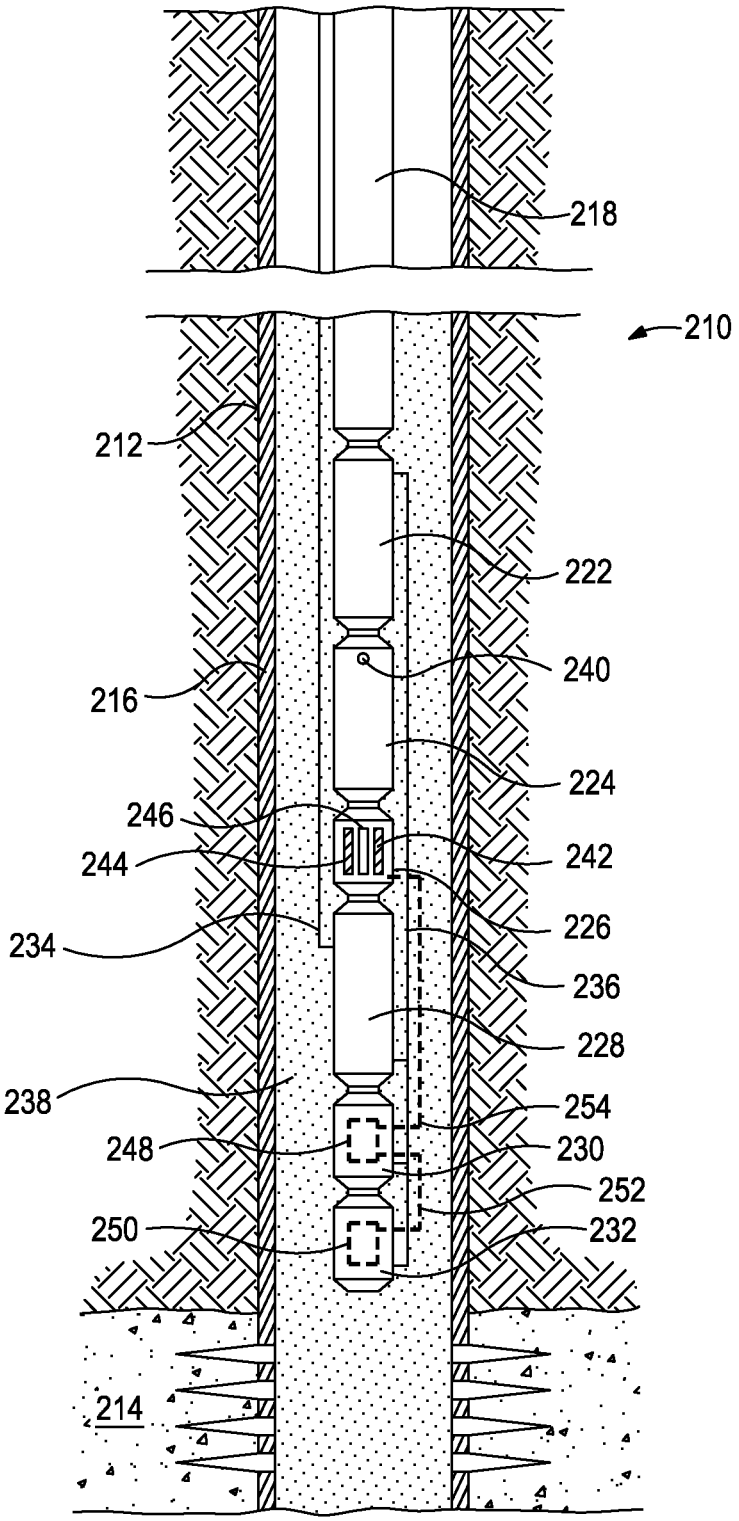
FIG. 3 is a schematic illustration of a submersible pump assembly positioned in a wellbore according to at least one embodiment described herein.

FIG. 3 is a schematic illustration of a submersible pump assembly 210 positioned in a wellbore 212 penetrating a subterranean formation 214 according to at least one embodiment described herein. A casing 216 is secured within wellbore 212. Similar to the submersible pump assembly 10 of FIG. 1, a tubing string 218 is disposed within the wellbore 212. The lower end of tubing string 218 includes various coupled tools such as a fluid pump 222, a gas separator 224, a fluid intake subassembly 226 with filter components 244 described herein as coupled to at least some of the inlets 242, a motor 228, a downhole control system 230, and a sensor subassembly 232. A cable assembly 234 extends from the surface to provide power to various components of the submersible pump assembly 210 and communication between the various components and the surface. A second cable assembly 236 is depicted as extending among various components of the submersible pump assembly 210 to provide communication therebetween.

In embodiments alternate to that illustrated in FIG. 3, the sensor subassembly 232 may be located elsewhere along the submersible pump assembly 210, for example, between the fluid pump 222 and the tubing string 218.

In some instances, the hydrocarbon and/or water concentration in the fluid 238 may be monitored by the sensor subassembly 232. When the hydrocarbon concentration becomes too low or the water concentration becomes too high, a flow line not coupled to a filter component described herein may be opened and used as a bypass to allow the fluid 228 to flow to the fluid pump 222 without passing through the filter components 244. As illustrated, the bypass is an intake inlet 246 not coupled to a filter component and configured to open and close (e.g., by a valve or the like) as needed to provide for bypass flow or not, respectively. The ability to utilize bypass flow may mitigate extra mechanical stresses on the fluid pump 222 from insufficient inlet flow due to high water concentrations, which effectively plugs the inlets 242 coupled to the filter components 244 described herein.

Actuation of the bypasses may be initiated downhole (e.g., by the downhole control system 230 as communicated via the second cable assembly 236) or by an operator at the surface (e.g., via the cable assembly 234). For example, a sensor 250 included in the sensor subassembly 232 may produce at least one output signal 252 corresponding to a concentration of water, a concentration of hydrocarbon, or both in the fluid 238. The output signal 252 may be conveyed to a signal processor 248, which is illustrated as a component of the downhole control system 230 where the output signal 252 is conveyed via the second cable assembly 236. In alternate embodiments, the signal processor 248 may be a component of the fluid intake subassembly 226 where the output signal 252 may alternatively be conveyed via the second cable assembly 236. In yet other embodiments, the signal processor 248 may alternatively be positioned within the sensor subassembly 232.

The signal processor 248 may be configured to determine an appropriate fluid flow configuration of the fluid intake subassembly 226 (i.e., through one or both of the inlets 242, 246) based on the hydrocarbon and/or water concentration and to produce an output signal 254 corresponding to the fluid flow configuration. As illustrated, the output signal 254 from the signal processor 248 may be conveyed to the fluid intake subassembly 226 to control the valves and other components of the fluid intake subassembly 226 that provide for the fluid flow configuration corresponding to the output signal 254.

In alternate embodiments, the output signal 252 corresponding to the water and/or hydrocarbon concentration may be conveyed to the surface via the cable assembly 234 for an operator or other control system (e.g., a computer with a processor) to determine the appropriate fluid flow configuration of the fluid intake subassembly 226. An appropriate fluid flow configuration may then be conveyed to the downhole control system 230 via the cable assembly 234 and, ultimately, the fluid intake subassembly 226 via the second cable assembly 236.

A processor may be configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

Figure 4:
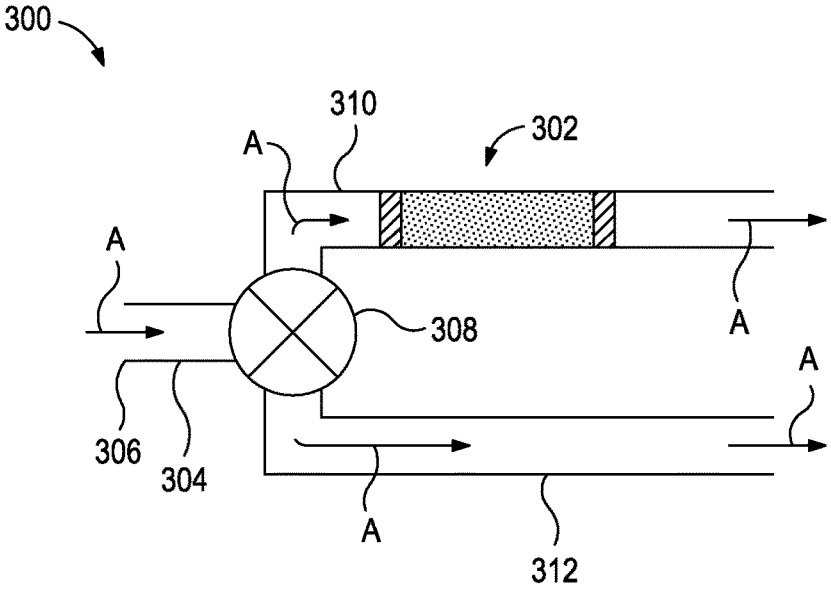
FIG. 4 is an exemplary diagram of flow system that provides bypass of a filter component described herein.

Those skilled in the art should recognize other mechanisms and configurations to provide for bypass flow in addition to or in place of flow through the filter components 244. For example, FIG. 4 provides an exemplary diagram of a flow system 300 that provides bypass of a filter component 302 described herein. The flow system 300 includes a flow line 304 with a valve 308 positioned downstream from an inlet 306. In some embodiments, the inlet 306 may comprise an inlet of one of the fluid intake subassemblies 10, 210 of FIGS. 1 and 3, respectively. In operation, the valve 308 may selectively direct fluid flow represented by arrows A in the flow line 304. In some cases, for example, the valve 308 may actuate to direct fluid flow A to a flow line 310 that includes a filter component 302. In other cases, the valve 308 may actuate to direct fluid flow A to a bypass flow line 312 that does not include a filter component. In yet other embodiments, the valve 308 may actuate to direct a fraction of the fluid flow A in both flow lines 310, 312 simultaneously. The fluid flow A from the flow line 310 and the bypass flow line 312 may then proceed to the gas separator and the fluid pump (not shown).

Accordingly, the valve 308 may be actuated and otherwise positioned to provide for fluid flow according to one of (1) flow through the flow line 310 and the filter component 302 and no flow through the bypass flow line 312, (2) no flow through the flow line 310 and the filter component 302 and flow through the bypass flow line 312, or (3) flow through the flow line 310 and the filter component 302 and flow through the bypass flow line 312.

Even though FIGS. 1 and 3 depict a vertical wellbore, it should be understood by those skilled in the art that the present disclosure is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Embodiments disclosed herein include, but are not limited to, Embodiment A, Embodiment B, and Embodiment C.

Embodiment A is a downhole assembly that includes a tool string that includes a fluid pump, a fluid intake subassembly, a motor, and a downhole control system each coupled such that a fluid flowing into the fluid intake assembly is conveyed to the fluid pump; one or more inlets defined in the fluid intake subassembly; a flow line fluidly coupled to at least one of the one or more inlets and containing a filter component that contains a filter media at least partially coated with a RPM, wherein the fluid flowing through the flow line contacts the RPM.

Embodiment A may have one or more of the following additional elements in any combination: Element A1: wherein the tool string further includes a gas separator and the fluid flowing into the fluid intake assembly is conveyed to the gas separator and then the fluid pump; Element A2: wherein the filter media has an oil permeability of about 1 Darcy or greater and a water permeability of about 0.5 times or less the oil permeability; Element A3: wherein the filter media comprises particulates; Element A4: wherein the filter media comprises fibers; Element A5: wherein the filter media comprises an open cell foam; Element A6: wherein the RPM comprises a copolymer of at least one hydrophobically modified hydrophilic monomer and at least one hydrophilic monomer; Element A7: wherein the RPM comprises a homopolymer of a hydrophilic monomer; and Element A8: wherein the RPM comprises a copolymer of two or more hydrophilic monomers.

By way of non-limiting example, exemplary combinations applicable to Embodiment A include: Element A1 in combination with one or more of Elements A2-A8; Element A2 in combination with one or more of Elements A3-A8; Element A3 in combination with Element A4 and optionally one or more of Elements A6-A8; Element A5 in combination with one or more of Elements A6-A8; and two or more of Elements A6-A8 in combination.

Embodiment B is a downhole assembly that includes a tool string that includes a fluid pump, a gas separator, a fluid intake subassembly, a motor, a downhole control system, and a sensor subassembly each coupled such that a fluid flowing into the fluid intake assembly is conveyed to the gas separator and then the fluid pump; one or more inlets defined in the fluid intake subassembly; a flow line fluidly coupled to at least one of the one or more inlets and containing a filter component that contains a filter media at least partially coated with a relative permeability modifier (RPM), such that the fluid flowing through the flow line contacts the RPM; a bypass flow line fluidly coupled to the flow line and not containing the filter component; and at least one valve positioned in the flow line to selectively direct the fluid through one or both of the bypass flow line and the filter component.

Embodiment B may have one or more of the following additional elements in any combination: Element B1: the downhole assembly further including a cable assembly that communicably couples the fluid intake assembly, the downhole control system, and the sensor subassembly, wherein the sensor produces a first output signal corresponding to a hydrocarbon concentration, a water concentration, or both that is received by a processor in the downhole control system via the cable assembly, and wherein the processor is programmed to determine a fluid flow configuration for the fluid intake assembly, produce a second output signal corresponding thereto, and transmit the second output signal to the fluid intake assembly via the cable assembly; Element B2: wherein the filter media has an oil permeability of about 1 Darcy or greater and a water permeability of about 0.5 times or less the oil permeability; Element B3: wherein the filter media comprises particulates; Element B4: wherein the filter media comprises fibers; Element B5: wherein the filter media comprises an open cell foam; Element B6: wherein the RPM comprises a copolymer of at least one hydrophobically modified hydrophilic monomer and at least one hydrophilic monomer; Element B7: wherein the RPM comprises a homopolymer of a hydrophilic monomer; and Element B8: wherein the RPM comprises a copolymer of two or more hydrophilic monomers.

By way of non-limiting example, exemplary combinations applicable to Embodiment B include: Element B1 in combination with one or more of Elements B2-B8; Element B2 in combination with one or more of Elements B3-B8; Element B3 in combination with Element B4 and optionally one or more of Elements B6-B8; Element B5 in combination with one or more of Elements B6-B8; and two or more of Elements B6-B8 in combination.

Embodiment C is a method that includes measuring a hydrocarbon concentration, a water concentration, or both of a fluid contained in a wellbore with a sensor that is coupled to a sensor subassembly of a tool string, the tool sting including a fluid pump, a gas separator, a fluid intake subassembly, a motor, a downhole control system, and a sensor subassembly each coupled such that a fluid flowing into the fluid intake assembly is conveyed to the gas separator and then the fluid pump, one or more inlets defined in the fluid intake subassembly; a flow line fluidly coupled to at least one of the one or more inlets and containing a filter component that contains a filter media at least partially coated with a relative permeability modifier (RPM), such that the fluid flowing through the flow line contacts the RPM; a bypass flow line fluidly coupled to the flow line and not containing the filter component; and at least one valve positioned in the flow line to selectively direct the fluid through one or both of the bypass flow line and the filter component; and actuating the at least one valve to provide for a fluid flow configuration through the fluid intake subassembly based on the hydrocarbon concentration, the water concentration, or both, the fluid flow configurations being: (1) fluid flow through the flow line and no fluid flow through the bypass flow line; (2) no fluid flow through the flow line and fluid flow through the bypass flow line; or (3) fluid flow through the flow line and fluid flow through the bypass flow line.

Embodiment C may have one or more of the following additional elements in any combination: Element C1: wherein the filter media has an oil permeability of about 1 Darcy or greater and a water permeability of about 0.5 times or less the oil permeability; Element C2: wherein the filter media comprises particulates; Element C3: wherein the filter media comprises fibers; Element C4: wherein the filter media comprises an open cell foam; Element C5: wherein the RPM comprises a copolymer of at least one hydrophobically modified hydrophilic monomer and at least one hydrophilic monomer; Element C6: wherein the RPM comprises a homopolymer of a hydrophilic monomer; and Element C7: wherein the RPM comprises a copolymer of two or more hydrophilic monomers.

By way of non-limiting example, exemplary combinations applicable to Embodiment C include: Element C1 in combination with one or more of Elements C2-C7; Element C2 in combination with Element C3 and optionally one or more of Elements C5-C7; Element C4 in combination with one or more of Elements C5-C7; and two or more of Elements C5-C7 in combination.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the disclosure embodiments disclosed herein are presented herein. Not all features of a physical implementation are described or shown in this application for the sake of clarity. It is understood that in the development of a physical embodiment incorporating the embodiments of the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

While compositions and methods are described herein in terms of "comprising" various components or steps, the compositions and methods can also "consist essentially of" or "consist of" the various components and steps.

To facilitate a better understanding of the embodiments of the present disclosure, the following examples of preferred or representative embodiments are given. In no way should the following examples be read to limit, or to define, the scope of the disclosure.

EXAMPLES

To illustrate the efficacy of RPM described herein to mitigating water flow and allowing oil flow, an Oklahoma #1 sand coated with a copolymer of DMEMA and alkyl-DMEMA halide (i.e., the RPM) was used to pack a column. Columns with uncoated Oklahoma #1 sand were used as a control. Through the uncoated sand column, brine (2% KCl solution) permeability was 122,000 mDarcy (mD), and oil permeability was 6472 mD. Through the coated sand columns, the brine permeability dropped over 350 times to 34 mD, while the oil permeability was substantially the same at 6815 mD. This illustrates that water preferentially does not flow through filter media coated with RPM described herein.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A downhole assembly comprising:

a tool string that includes a fluid pump, a fluid intake subassembly, a motor, and a downhole control system each coupled such that a fluid flowing into the fluid intake assembly is conveyed to the fluid pump;

one or more inlets defined in the fluid intake subassembly;

a flow line fluidly coupled to at least one of the one or more inlets and containing a filter component that contains a filter media at least partially coated with a relative permeability modifier (RPM), wherein the fluid flowing through the flow line contacts the RPM, wherein the filter media has an oil permeability of about 1 Darcy or greater and a water permeability of about 0.5 times or less the oil permeability.

2. The downhole assembly of claim 1, wherein the tool string further includes a gas separator and the fluid flowing into the fluid intake assembly is conveyed to the gas separator and then the fluid pump.

3. The downhole assembly of claim 1, wherein the filter media comprises particulates.

4. The downhole assembly of claim 1, wherein the filter media comprises fibers.

5. The downhole assembly of claim 1, wherein the filter media comprises an open cell foam.

6. The downhole assembly of claim 1, wherein the RPM comprises a copolymer of at least one hydrophobically modified hydrophilic monomer and at least one hydrophilic monomer.

7. The downhole assembly of claim 1, wherein the RPM comprises a homopolymer of a hydrophilic monomer.

8. The downhole assembly of claim 1, wherein the RPM comprises a copolymer of two or more hydrophilic monomers.

9. A downhole assembly comprising:

a tool string that includes a fluid pump, a gas separator, a fluid intake subassembly, a motor, a downhole control system, and a sensor subassembly each coupled such that a fluid flowing into the fluid intake assembly is conveyed to the gas separator and then the fluid pump;

one or more inlets defined in the fluid intake subassembly;

a flow line fluidly coupled to at least one of the one or more inlets and containing a filter component that contains a filter media at least partially coated with a relative permeability modifier (RPM), such that the fluid flowing through the flow line contacts the RPM;

a bypass flow line fluidly coupled to the flow line and not containing the filter component; and at least one valve positioned in the flow line to selectively direct the fluid through one or both of the bypass flow line and the filter component.

10. The downhole assembly of claim 9 further comprising:

a cable assembly that communicably couples the fluid intake assembly, the downhole control system, and the sensor subassembly, wherein the sensor produces a first output signal corresponding to a hydrocarbon concentration, a water concentration, or both that is received by a processor in the downhole control system via the cable assembly, and wherein the processor is programmed to determine a fluid flow configuration for the fluid intake assembly, produce a second output signal corresponding thereto, and transmit the second output signal to the fluid intake assembly via the cable assembly.

11. The downhole assembly of claim 9, wherein the filter media has an oil permeability of about 1 Darcy or greater and a water permeability of about 0.5 times or less the oil permeability.

12. The downhole assembly of claim 9, wherein the filter media comprises particulates.

13. The downhole assembly of claim 9, wherein the filter media comprises fibers.

14. The downhole assembly of claim 9, wherein the filter media comprises an open cell foam.

15. A method comprising:

measuring a hydrocarbon concentration, a water concentration, or both of a fluid contained in a wellbore with a sensor that is coupled to a sensor subassembly of a tool string, the tool sting including a fluid pump, a gas separator, a fluid intake subassembly, a motor, a downhole control system, and a sensor subassembly each coupled such that a fluid flowing into the fluid intake assembly is conveyed to the gas separator and then the fluid pump, one or more inlets defined in the fluid intake subassembly; a flow line fluidly coupled to at least one of the one or more inlets and containing a filter component that contains a filter media at least partially coated with a relative permeability modifier (RPM), such that the fluid flowing through the flow line contacts the RPM; a bypass flow line fluidly coupled to the flow line and not containing the filter component; and at least one valve positioned in the flow line to selectively direct the fluid through one or both of the bypass flow line and the filter component; and actuating the at least one valve to provide for a fluid flow configuration through the fluid intake subassembly based on the hydrocarbon concentration, the water concentration, or both, the fluid flow configurations being: (1) fluid flow through the flow line and no fluid flow through the bypass flow line; (2) no fluid flow through the flow line and fluid flow through the bypass flow line; or (3) fluid flow through the flow line and fluid flow through the bypass flow line.

16. The method of claim 15, wherein the filter media has an oil permeability of about 1 Darcy or greater and a water permeability of about 0.5 times or less the oil permeability.

17. The method of claim 15, wherein the filter media comprises particulates.

18. The method of claim 15, wherein the filter media comprises fibers.

19. The method of claim 15, wherein the filter media comprises an open cell foam.

* * * * *